US012760439B2

(12) United States Patent
Van De Ven et al.

(10) Patent No.: US 12,760,439 B2
(45) Date of Patent: Oct. 13, 2026

(54) DEVICE AND METHOD FOR ELECTROLYTIC TREATMENT OF SUBSTRATES

(71) Applicant: MECO EQUIPMENT ENGINEERS B.V., 'S-Hertogenbosch (NL)

(72) Inventors: Augustinus Cornelis Maria Van De Ven, 'S-Hertogenbosch (NL); Patrick Wesley De Visser, 'S-Hertogenbosch (NL); Arjan Hovestad, 'S-Hertogenbosch (NL)

(73) Assignee: MECO EQUIPMENT ENGINEERS B.V., S-Hertogenbosch (NL)

( * ) Notice: Subject to any disclaimer, the term of this patent is extended or adjusted under 35 U.S.C. 154(b) by 0 days.

(21) Appl. No.: 18/704,222

(22) PCT Filed: Dec. 2, 2022

(86) PCT No.: PCT/NL2022/050692

§ 371 (c)(1),
(2) Date: Apr. 24, 2024

(87) PCT Pub. No.: WO2023/106914

PCT Pub. Date: Jun. 15, 2023

(65) Prior Publication Data

US 2024/0417880 A1 Dec. 19, 2024

(30) Foreign Application Priority Data

Dec. 7, 2021 (NL) ..... 2030054

(51) Int. Cl.

| | |
|---|---|
| ***C25D 17/02*** | (2006.01) |
| ***C25D 17/00*** | (2006.01) |
| ***C25D 17/06*** | (2006.01) |

(52) U.S. Cl.
CPC ..... *C25D 17/06* (2013.01); *C25D 17/008* (2013.01); *C25D 17/02* (2013.01)

(58) Field of Classification Search
None
See application file for complete search history.

(56) References Cited

U.S. PATENT DOCUMENTS 3,278,409 A * 10/1966 Barringer ..... C25D 17/08 204/198
4,372,825 A * 2/1983 Eidschun ..... C25D 5/08 204/279

(Continued)

FOREIGN PATENT DOCUMENTS

| | | |
|---|---|---|
| DE | 19717511 A1 | 10/1998 |
| DE | 10358147 C | 5/2005 |
| WO | 2009126021 A2 | 10/2009 |

OTHER PUBLICATIONS

PCT International Search Report dated Feb. 8, 2023; PCT/NL2022/050692.

*Primary Examiner* — Stefanie S Wittenberg
(74) *Attorney, Agent, or Firm* — Suiter Swantz IP

(57) ABSTRACT

The invention provides a system for electrolytic treatment of vertically oriented substrates. The system may include an elongated bath for electrolytic liquid, a conveyor for conveying substrates to be treated electrolytically, vertically oriented and suspended from the conveyor, in a transport direction according to a horizontal transport path through an electrolytic liquid in the bath, the conveyor being arranged for clamping the substrates near a top thereof during conveyance of the substrates through the electrolytic liquid in the bath. The system may further include a number of flow devices each with at least one discharge orifice in the bath, the discharge orifices being directed in a discharge direction that extends opposite to the transport direction for creating (Continued)

a flow of electrolytic liquid, with a flow direction that is opposite to the transport direction, in the electrolytic liquid along at least one longitudinal side of substrates suspended from the conveyor.

20 Claims, 5 Drawing Sheets

(56) References Cited

U.S. PATENT DOCUMENTS

| | | | | |
|---|---|---|---|---|
| 4,601,794 | A | 7/1986 | Tsuda et al. | |
| 4,755,273 | A * | 7/1988 | Bassett | C25D 13/22 118/501 |
| 4,981,559 | A * | 1/1991 | Sato | C25D 5/08 204/237 |
| 2005/0205429 | A1 | 9/2005 | Gebhart et al. | |
| 2006/0151328 | A1* | 7/2006 | Reents | C25D 5/18 257/E21.175 |
| 2007/0163886 | A1* | 7/2007 | Hara | C25D 13/22 204/622 |
| 2015/0252488 | A1 | 9/2015 | Wiener et al. | |

* cited by examiner

DEVICE AND METHOD FOR ELECTROLYTIC TREATMENT OF SUBSTRATES

The invention relates to a system and method for electrolytic treatment of substrates.

A system and a method for electrodeposition of substrates are known from US 2005/0205429 A1. This publication describes an electrolytic system wherein a vertically oriented substrate is positioned in an electrolytic liquid in a bath for electrolytic liquid by means of a holder that extends on one longitudinal side of the substrate. On the underside of the substrate, two horizontal rows of eductors are provided in the bath on opposite sides of the substrate, seen in top view, wherein the discharge orifices of the eductors of the two rows are directed in the horizontal direction to each other. In use, electrolytic liquid flows in the horizontal direction out of the respective discharge orifices but shortly after this respective discharge the electrolytic liquid is deflected by means of guides through 90 degrees upwards and the electrolytic liquid then flows upwards along the substrate. By means of the eductors and the specific placement and orientation thereof, the aim is to achieve uniform electrodeposition.

WO 2009/126021 A2 describes a method and device for continuous electrolytic galvanizing of substrates. Supply of electrolytic liquid to the bath through which substrates are transported takes place by means of a supply pipe that discharges in the bath under the substrates.

The invention aims to provide an improved device and method. More specifically, the invention aims to provide a device with which a higher treatment speed can be attained. If the invention is applied for electrodeposition of substrates, the aim is to attain a higher deposition rate. The invention further aims to provide a device with which a more uniform electrolytic treatment can be achieved. More specifically, the invention aims to provide a device with which an electrolytic treatment can be achieved with comparable uniformity at increased treatment speed. The invention further aims to provide a device that is suitable for relatively fragile, such as glass-like, substrates. The invention further aims to provide a device with which large-scale production is possible.

To achieve at least some of the aforementioned aims, the invention provides a device according to claim 1. In so far as there could already be lack of clarity, it is pointed out that the transport path can be defined as the space that is taken up by successive substrates, each of which in the context of the present disclosure typically are plate-shaped, in the bath during said transport. When using the system according to the invention a counterflow of electrolytic fluid with respect to the transport direction is created and thus a relatively large speed difference can be achieved between the substrates that are transported through the electrolytic liquid on the one hand and the flow of electrolytic liquid in the direct environment of the substrates. In this way, a high degree of renewal of electrolytic liquid at the surfaces of the substrates to be treated electrolytically can be achieved, so that a high treatment speed and in the case of electrodeposition a high deposition rate can be achieved. As the treatment speed increases in continuous electrolytic processes wherein substrates are transported continuously through an electrolytic liquid in a bath, a shorter bath may be selected with a transport speed that remains the same to attain the same productivity, but also a bath of the same length with a higher transport speed wherein the productivity may be increased. It is obvious that the transport speed determines the residence time in the electrolytic liquid and, together with the treatment speed, also the extent of the treatment, i.e. concretely in electrodeposition, determines the thickness of the deposited layer.

In one embodiment, the discharge orifices are provided seen in top view on two opposite sides of the transport path, for creating the flow of electrolytic liquid along two opposite sides. Besides it then being possible to have the electrolytic treatment take place to the same extent on the two opposite longitudinal sides of each substrate, the mechanical forces that act on the opposite longitudinal sides of each substrate upon each substrate must be identical on account of the flow of electrolytic liquid so that the flow does not give rise to a bending moment on each substrate such that in particular relatively fragile, such as glass-like, substrates might break.

Both with respect to design and process, it may be advantageous if at least two, preferably at least three, of the number of discharge orifices form at least one row. If a row comprises at least three discharge orifices, such a row is preferably rectilinear and/or the discharge orifices are located within the row at identical distance from each other or at least in a regular pattern.

In an embodiment wherein at least one row of the at least one row extends in the horizontal direction, it is possible, over a relatively large part of the length of the bath, to create a flow of electrolytic liquid with a flow direction that is opposite to the transport direction, wherein in addition the speed of the flow over that part of the length of the electrolytic bath varies relatively little. This is beneficial for the uniformity of the electrolytic treatment.

In a further embodiment at least one row of the at least one row extends in the vertical direction. This may in particular be useful if the height of the region of the substrates to be treated electrolytically is at least 30 mm, so that uniformity of the electrolytic treatment, viewed over the height of the substrates, is promoted.

The supplying of electrolytic liquid to the discharge orifices may in the aforementioned embodiment with a vertical row, with efficient design, be facilitated if the discharge orifices belonging to a vertical row are connected to a common supply line for electrolytic liquid.

In one embodiment, the system comprises at least one tank for electrolytic liquid, and said at least one tank is installed outside the bath and the flow devices are connected via supply lines that extend via a passage in a wall or the bottom of the bath, to one tank of the at least one tank. A continuous supply of electrolytic liquid to the flow devices can thus be guaranteed, wherein the tank serves as a buffer. The tank then preferably forms a component of a recirculation system that returns electrolytic liquid, derived from the electrolytic bath, back to the electrolytic bath. In a recirculation system of this kind, supplies may also be incorporated for conditioning the electrolytic liquid, such as heating or filtering the electrolytic liquid, for example to a temperature between 3° and 60° C., such as between 35 and 40° C.

Both with respect to design and process, it may further be advantageous if at least four, preferably at least six, of the number of discharge orifices form at least two rows, preferably each of at least three discharge orifices, particularly if at least two rows of the at least two rows extend parallel to each other and/or if at least two rows of the at least two rows extend on opposite sides of the transport path.

In one embodiment, each flow device is provided with not more than one discharge orifice. The flow device and the associated discharge orifice may thus easily be optimized to fulfil their function.

A possible embodiment may also be obtained if the flow devices are eductors. An eductor is characterized in that said flow devices make use of the Venturi effect to create a flow ($cm^3/s$) of liquid from the discharge orifice thereof whose magnitude is greater than the flow of liquid that is supplied to the eductor by means of a pump. The discharge flow can be up to five times greater than the inflow.

To increase the uniformity with which substrates are treated electrolytically, it may be advantageous if the system comprises at least one guide body for guiding electrolytic liquid that flows in respective flow directions from discharge orifices, towards the substrates.

In a potentially favourable embodiment with respect to design and process, the at least one guide body is plate-shaped and the at least one guide body has guide passages wherein the plate shape extends vertically and parallel to the transport path. When using the system, electrolytic liquid first flows through the guide passages and then between the respective guide body and the substrates. The magnitude of a suitable distance between the guide body and the substrates is typically at most 30 mm and preferably at least 10 mm.

If the at least one guide body, seen in top view, is provided between the transport path and at least one discharge orifice, the advantage may thus be obtained that the liquid stream is distributed more evenly over the surface of each substrate, with a more uniform eletrolytic treatment in consequence.

In a simple design, effective guidance can be obtained if each guide passage has a peripheral edge, of which, seen in the transport direction, the side facing the substrate is located at the front of the side turned away from the substrate.

In order to limit the mechanical load on the substrates, it may be preferable for the system to comprise at least two guide bodies, which, seen in top view, are provided on opposite sides of the transport path. It is thus also advantageously possible to treat substrates electrolytically on two opposite sides.

The direction of the stream of the electrolytic liquid may in particular be controlled well if the guide body is provided with a guide edge for guiding a substrate on the underside thereof during transport through the electrolytic liquid in the bath.

In a particular embodiment, the conveyor is arranged for clamping substrates to be treated electrolytically near a top thereof during transport of the substrates through the electrolytic liquid in the bath.

In a further embodiment, the bath is provided with a receiving space that is positioned directly under the transport path for receiving substrates or parts thereof that come loose from the conveyor during transport of the substrates. Especially in the case of glass-like substrates, there is by definition an increased risk of substrates or parts thereof coming loose from the conveyor. These parts or substrates that have come loose present a risk of ending up in the path of upstream substrates, so that these substrates or parts thereof might also come loose from the conveyor. In this embodiment it is not necessary to halt the production or at least the conveyor of the system, and for the parts that have come loose to be removed from the bath before restarting production or the conveyor. This is disadvantageous both economically and with respect to process. The receiving space may prevent parts or substrates that have come loose ending up in the path of upstream substrates. Acute intervention if parts or substrates come loose is not then necessary.

In a pragmatic embodiment, the receiving space is provided with a bottom that is located at a distance of at least 10 cm under the lowest discharge orifice of the discharge orifices. The lowest discharge orifice will in practice be provided on the underside of the substrates.

The level of the electrolytic liquid in the bath can be controlled well if the system comprises at least one overflow space for receiving electrolytic liquid that flows over an overflow edge of the bath. The overflow edge then determines in principle, together with the rate at which electrolytic liquid is supplied to the bath, the level of the electrolytic liquid in the bath or at least the highest possible level.

In a further optional embodiment the system comprises two or more baths which are aligned with each other, the conveyor being arranged for conveying the substrates successively through electrolytic fluid in each of the baths according to a straight transport path. In all of these baths a counterflow can be established using the flow devices present in those baths. The overflow space as referred to in the preceding paragraph can be arranged for receiving electrolytic fluid from each of the baths.

According to a further aspect of the invention, the invention provides a method for electrolytic treatment of substrates using a system according to the invention as described above, whether or not in possible embodiments thereof. The method comprises the steps of

- by means of the conveyor, conveying substrates suspended from the conveyor in a transport direction through an electrolytic liquid in the elongated bath; and
- creating, in the bath from at least one discharge orifice, a flow of electrolytic liquid along at least one longitudinal side of the substrates suspended from the conveyor, said flow having a flow direction that is opposite to the transport direction.

The effectiveness of the electrolytic treatment can in particular be increased if the magnitude of the speed difference is between 10 metres per minute (m/min) and 40 metres per minute (m/min).

In one embodiment, the speed of the substrates is between 5 metres per minute (m/min) and 10 metres per minute (m/min). Such speeds are now also used in existing systems. Thus, although the speeds are not lowered or although the baths are not made longer in order to make the residence time of the substrates in the electrolytic liquid longer, owing to the invention the effectiveness of the electrolytic treatment can be increased. In the case of electrodeposition of substrates, for example, a higher deposition rate can be attained.

In the prior art, the difference in speed between the substrates and the electrolytic liquid is only obtained owing to the speed of movement of the substrate, because the bath is static; the contribution of the supply from the supply pipe from the bottom is negligible. The direction of flow in the prior art is from below (from the supply pipe) upwards (where the liquid flows over the edges of the bath), so there is no factor in the direction of motion of the substrates. In the device and the method according to the present invention it is a question of an intentionally applied counterflow and thus a factor in the direction of motion of the substrates. The continuous renewal of electrolytic liquid at the location of the substrates has the result that the average current density can be increased relative to the average current density such as is attained in practice according to the prior art. In other words, with the method according to the invention, an increased current density can be used in the method while maintaining uniformity of the treated substrate. At a higher current density, a comparable layer thickness will be obtained at a shorter deposition time. In other words, the method can be speeded up by increasing the current density.

With a method according to the prior art, where there is no question of counterflow, irregular, rough layers are obtained, consisting of nodules and/or dendrites, when the current density is increased. This is due to local differences in the deposition rate on the substrate. The inventors have now found that this formation of nodules and/or dendrites and uneven metal deposition are a consequence of insufficient renewal of the electrolyte during metal deposition owing to a low flow rate on the surface of the substrate, and that this can be solved by the present invention.

In this context, in one embodiment, during the electrolytic treatment it is a question of an average current density on the substrate of at least 30 amperes per square decimetre ($A/dm^2$) and preferably of at most 100 amperes per square decimetre ($A/dm^2$). At current densities above 100 amperes per square decimetre ($A/dm^2$), such a high speed of the flow of electrolytic liquid with a flow direction that is opposite to the transport direction would be required, that there would be a/an (excessively) high risk of turbulence of the electrolytic liquid, so that the respective electrolytic treatment could not be controlled well.

The deposition rate can be calculated in a manner known by a person skilled in the art. As an example, in the case of deposition of copper, this is smaller by a factor of 4.5 than the current density; this is derived from Faraday's law. Whereas, according to the prior art, it is possible in a production environment, in the electrodeposition of copper, to reach average deposition rates of typically approx. 5 micrometres per minute (μm/min) and in the case of tin of typically 10 micrometres per minute (μm/min), a further embodiment is characterized in that the electrolytic treatment is the electrolytic deposition of copper and in that the average deposition rate is at least 10 micrometres per minute (μm/min) and another further embodiment is characterized in that the electrolytic treatment is the electrolytic deposition of tin and in that the average deposition rate is at least 20 micrometres per minute (μm/min).

An electrolytic liquid is employed for the present invention. Said liquid comprises a metal salt, for example a copper salt (such as copper (II) sulphate) or a tin salt (such as tin (II) methane sulphate) and one or more acids, such as sulphuric acid ($H_2SO_4$) and/or methanesulphonic acid ($CH_3SO_3H$) and/or hydrochloric acid (HCl) and usually an additive that is known in this field and that is employed to allow the metal film to grow nicely.

The progress of production can be guaranteed with a higher degree of certainty if, when using a system with a receiving space as explained above, a bottom of the receiving space is located at a distance below the undersides of substrates suspended from the conveyor, said distance being greater than the vertical dimension of the substrates suspended from the conveyor. Thus, there is always sufficient space under the substrates suspended from the conveyor for any substrate that has come loose from the conveyor not to come into the path of upstream substrates suspended from the conveyor.

The invention is suitable in particular for application with glass-like substrates, such as silicon-based substrates, such as may in particular be under discussion for the large-scale production of solar cells. A good example of such substrates is a square panel of silicon or at least largely of silicon or at least of 99% silicon, with sides with a length between approx. 125 mm and 210 mm and with a thickness between 50 micrometres and 300 micrometres. Such panels are very fragile and are used in the production of solar cells.

These substrates are provided on one or more surfaces thereof with electrically conductive tracks, which are also called contact fingers. These electrically conductive tracks may for example be present in a matrix pattern.

In a specific embodiment, silicon-based substrates are provided, in a first step, with a vacuum-deposited copper layer on at least one surface of the substrate, after which, in a second step, a mask of an insulating material (e.g. a wax) is applied by printing, in which recesses are present, which form the electrically conductive tracks. In a third step, namely the electrolytic deposition process according to the present invention, a deposited layer is applied in these recesses, to form thickened tracks. The first two steps are known by a person skilled in the art. In another embodiment, said tracks may be applied prior to the process according to the invention, by vacuum deposition or printing, as known by a person skilled in the art. Said tracks are for example of copper, wherein during the method according to the invention the copper tracks are thickened with copper, tin or silver.

For a solar cell that operates well, it is necessary that the tracks/contact fingers are flat and smooth, so that they have high electrical conduction and have good solderability for solar cell module interconnection. With a smooth/flat surface, or a homogeneous surface, of the electrolytically deposited material, the efficiency of the solar cells will be better.

The variation in the thickness of the surface of the electrolytically deposited material is also called surface roughness. This is used as a quality criterion.

A usual means for assessing this is the arithmetic mean roughness (Ra). Ra is the average roughness in μm of the arithmetic means of the absolute values, which a person skilled in the art knows how to calculate. This is preferably <1 micrometre.

Another usual means is calculation of the percentage deviation for a convex shape, wherein a percentage deviation of >−20% is acceptable. In one embodiment the percentage deviation is >−20%, preferably >−15%, such as >−10%.

$$\%\ \text{deviation} = \frac{\text{height}_{centre} - \text{height}_{edge}}{\text{height}_{maximum}} \times 100$$

in which $\text{height}_{centre}$ is the height of the middle of the convex shape, wherein $\text{height}_{edge}$ is the height at the edges of the convex shape and wherein $\text{height}_{maximum}$ is the maximum height (e.g. of a nodule/peak or else of the centre if that is highest).

The invention is explained in more detail hereunder on the basis of a possible embodiment of a system according to the invention that is suitable for carrying out the method according to the invention, referring to the following figures FIG. 1 shows a system according to the invention in vertical cross-section;

Figure 1:
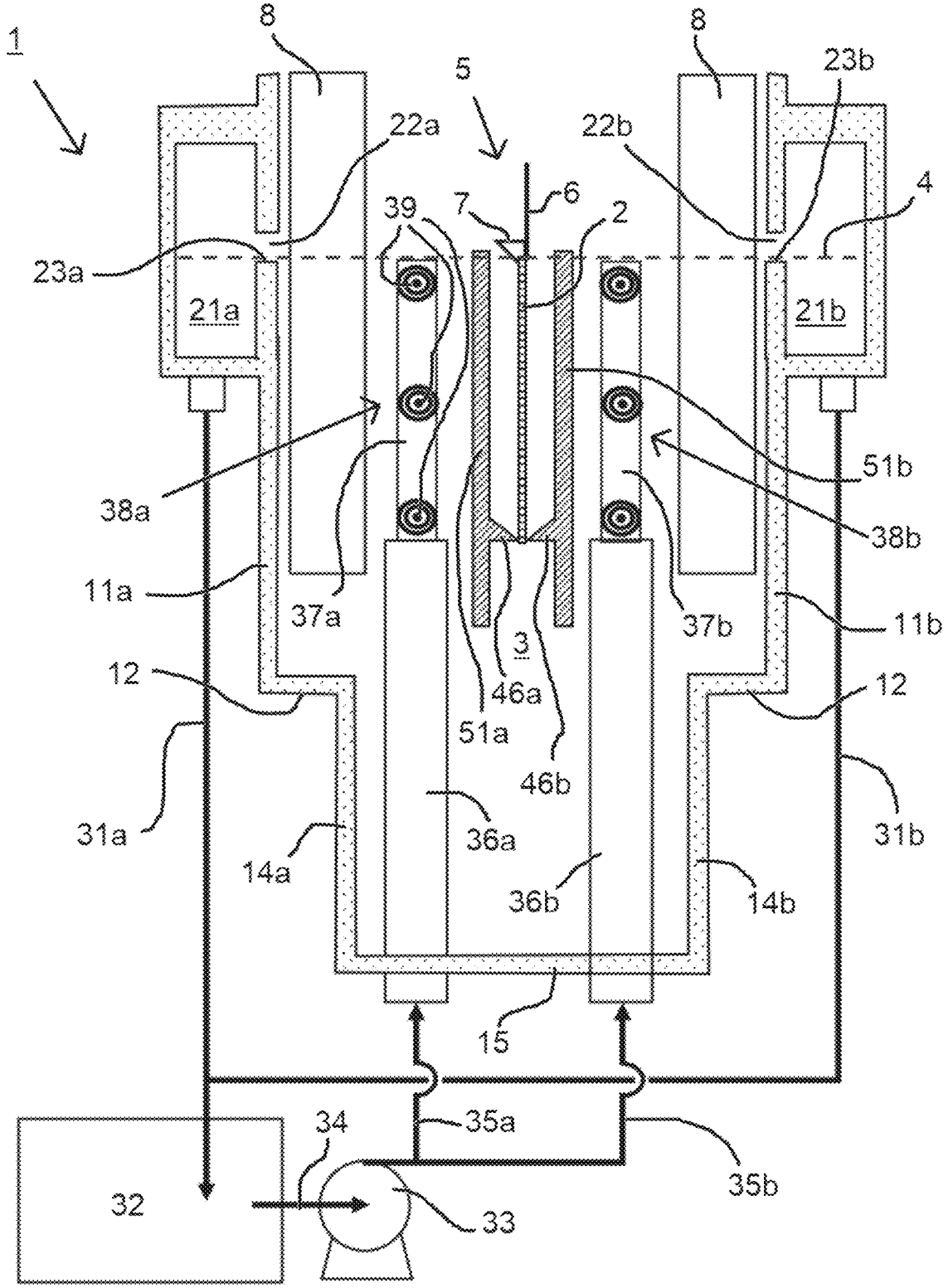

System 1 for continuous electrolytic treatment of individual substrates 2 comprises an elongated bath 3 with electrolytic liquid 4 therein with for example copper ions, which are dissolved in the electrolytic liquid 4 from metal, for example spherical, present in anode baskets 8 and which are intended to be deposited on account of the electrolytic treatment on the substrates 2, more specifically on tracks thereon, to form a copper layer thereon. The substrates 2 are for example glass-like, such as of silicon, and are each plate-shaped, for example square, wherein the sides each have a length that is between 125 mm and 210 mm.

The longitudinal direction of the elongated bath 3 extends in horizontal direction perpendicular to the plane of the drawing according to FIG. 1. The system 1 comprises a conveyor 5 for continuously conveying the substrates 2 in a horizontal transport direction 9 following a transport path 10 in the longitudinal direction of the bath 3 from a first end of the bath 3 on the right side of FIG. 2 to a second end of the bath, opposite to the first end, on the left side of FIG. 2 through the electrolytic liquid in the bath 3. During normal operation the speed of the conveyance of the substrates 2 is constant. The conveyor 5 comprises an endless strip 6 that is wrapped around two deflection pulleys, which are provided at opposite ends of the bath 3. The conveyor 5 further comprises clamps 7, which are connected to the strip 6 at a regular distance from each other and are arranged to clamp the substrates 5, in practice at a regular distance from each other, each against the strip 6 near the upper sides of the substrates 2. The substrates 2 are thus conveyed suspended from the strip 6 leaving both longitudinal sides thereof free to be approached by metal ions in the electrolytic fluid within the bath 3 thus for the electrolytic treatment while the electrolytic fluid flows in the opposite direction with respect tot the transport directions 9, so in counterflow, as will be further explained in the following Bath 3 has side walls 11*a*, 11*b* opposite each other and a bottom 12. The bottom 12 comprises a recessed portion, which in use serves as a receiving space 13 for substrates 2 or parts thereof that come loose from the conveyor 5 unexpectedly. Receiving space 13 extends over the full length of the bath 3 and has side walls 14*a*, 14*b* opposite each other and a bottom 15. The distance between the bottom 15 and the underside of a substrate 2 suspended from the conveyor 5 is greater than the height of the substrate 2, so that even if a substrate 2 were to come loose completely from the conveyor 5 and sink under the effect of gravity into the receiving space 13, this substrate 2 that has come loose would not end up in the path of upstream substrates 2 suspended from the conveyor 5. Bath 3 is provided at aforementioned first and second ends thereof with transverse walls which each join with ends of the longitudinal walls 11*a*, 11*b*, 14*a*, 14*b* and bottoms 12, 15. In each of these transverse walls vertical slits are provided through which substrates 2 enter the bath 3 at the first end thereof and exit the bath 3 at the second end thereof during conveyance of the substrates 2, thus creating a reservoir of electrolytic fluid within bath 3 for conveying the substrate 2 through this electrolytic liquid.

On the outer sides of each of the side walls 11*a*, 11*b* there are overflow spaces 21*a*, 21*b*. Electrolytic liquid 4 can flow via openings 22*a*, 22*b* in the side walls 11*a*, 11*b* into these overflow spaces 21*a*, 21*b*. Thus, the lower edges 23*a*, 23*b* of the openings 22*a*, 22*b*, said edges 23*a*, 23*b* being located at the same vertical level, largely determine, when using system 1, the level of the electrolytic liquid 4 in bath 3. At the outer sides of aforementioned transverse walls also overflow spaces have been provided for electrolytic fluid flowing from the bath 3 through the vertical slits therein.

The overflow spaces 21*a*, 21*b* are in communication via lines 31*a*, 31*b* with buffer system 32 for electrolytic liquid. The electrolytic liquid is conditioned in buffer system 32 so that it is again suitable to be returned to the bath 3. For this purpose, the electrolytic liquid is for example filtered and heated in the buffer system 32. For the purpose of supplying electrolytic liquid from the buffer system 32 to the bath 3, supply lines 34, 35*a*, 36*a*, 35*b*, 36*b* are provided, in which pump 33 is incorporated. The supply lines 35*a*, 35*b* extend through bottom 15 and open at their upper ends into respective collecting lines 37*a*, 37*b*, which also extend vertically.

The collecting lines 37*a*, 37*b* each form part of a flow device 38*a*, 38*b*, which, viewed in the transport direction 9, are provided in the bath 3 at a regular distance from each other, for example at a distance of between 40 cm and 90 cm, such as 60 cm, and on either side of the substrates 2. Uniformly distributed over the length of the collecting lines 37*a*, 37*b*, each flow device 38*a*, 38*b* is provided with three eductors 39. Each eductor 39 thus forms part of a vertical row of three eductors 39 but also of a horizontal row of eductors 39, extending parallel to the transport direction 9, the number of which is related to the length of the bath 3.

Figure 3:
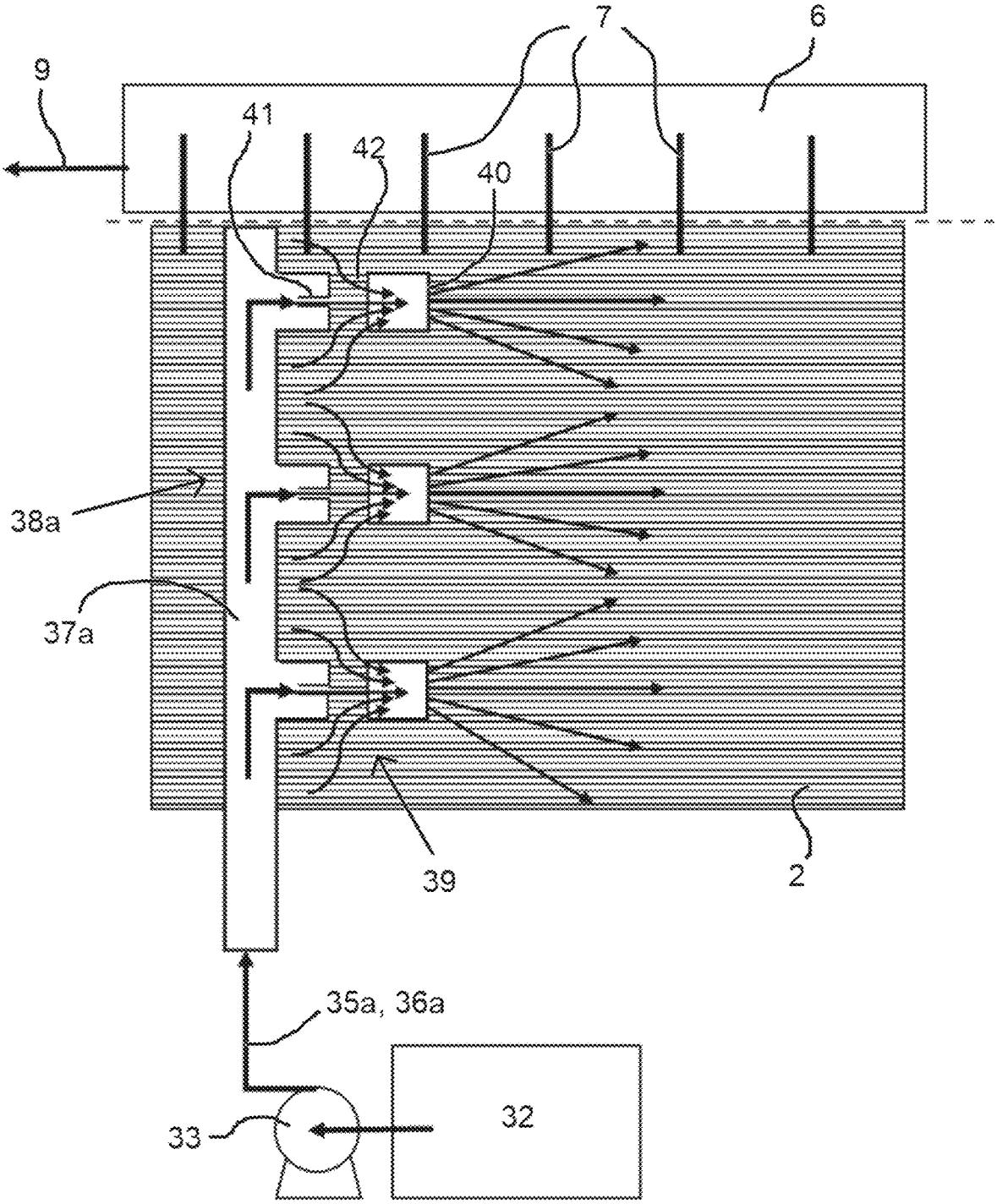
FIG. 3 shows schematically a part of the system in side view.
Figure 4:
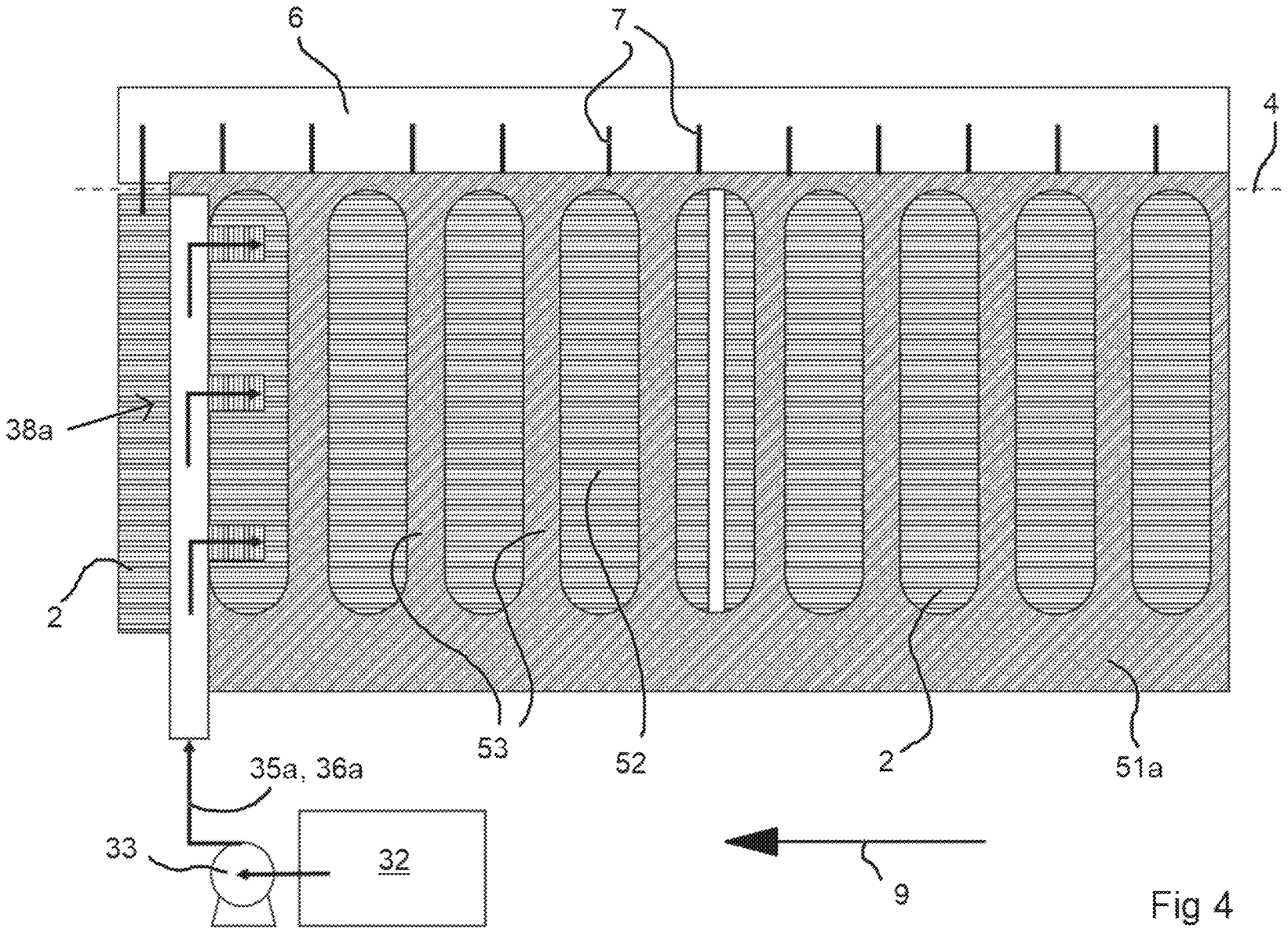
FIG. 4 shows schematically a part of the system in another side view.

Referring to FIG. 3, in which for clarity the guide plate 51*a* (FIG. 4), yet to be discussed further, is not shown, the eductors 39 are substantially cylindrical in shape and they each have a discharge orifice 40, directed in a direction opposite to the transport direction 9. In addition, each of the eductors 39 has a constricted intake 41 and between said intake 41 and the associated discharge orifice 40, a number of suction openings 42, which are uniformly distributed over the perimeter of tubular shape of the eductors 39. In use, the constricted intake 41 of each eductor 39 will greatly increase the speed of the electrolytic liquid, as supplied by pump 33 to the constricted intake 41, on the exit side of the intake 41. Through the Venturi effect, this increased speed of the electrolytic liquid through the associated suction openings 42 will have a suction action on electrolytic liquid 4 in the bath 3 so that finally the volume flow of electrolytic liquid flowing from discharge orifice 40 is up to five times higher than the volume flow through the constricted intake 41.

Figure 5:
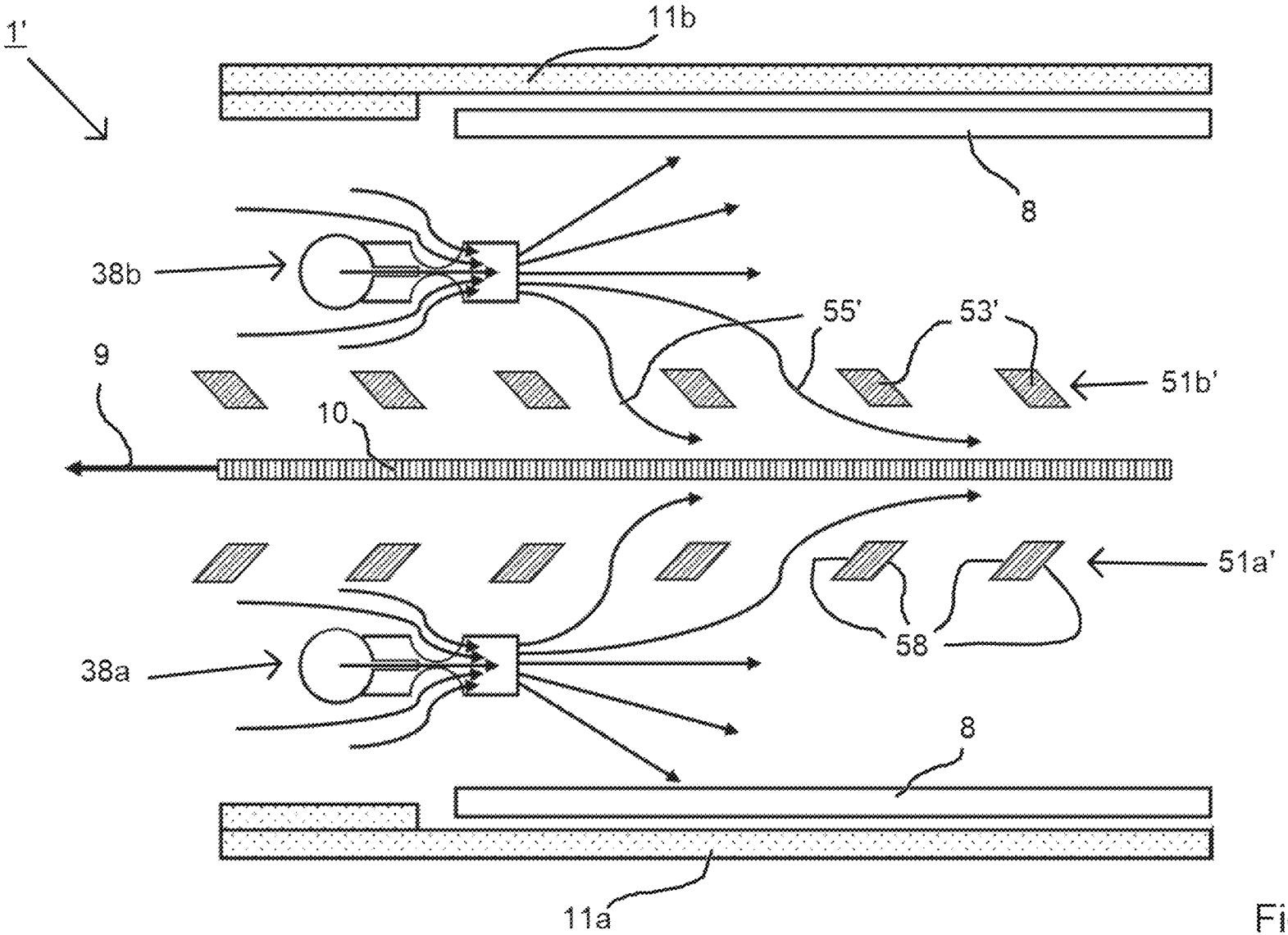
FIG. 5 shows schematically a part of the system in top view.

The eductors 39 extend within the height of the passing substrates 2 so that the substrates 2 are to a large extent exposed uniformly to the action of the eductors 39. Between the flow devices 38*a*, 38*b* and the substrates 2, the system further comprises substantially plate-shaped guide bodies 51*a*, 51*b*, which extend parallel to the substrates 2 and thus to the transport direction 9. In the guide bodies 51*a*, 51*b*, elongated, vertically oriented openings 52 are provided, which are separated from each other by bridge parts 53 of the guide bodies 51*a*, 51*b*. The eductors 39 extend within the length of the openings 52. In horizontal cross-section, the bridge parts 53 have a rectangular shape but alternatively shaped cross-sections are also possible, such as diamond-shaped cross-sections as shown in FIG. 5 for bridge parts 53' for alternative guide bodies 51*a*' and 51*b*'. In FIG. 5, the same reference numbers are used as in the preceding figures. If the components are different, a prime is added to the respective reference number. It can clearly be seen in FIG. 5 that each guide passage has a peripheral edge 58, of which, viewed in the transport direction 9, the side facing the substrate 2 is located at the front of the side turned away from the substrate 2.

Guide bodies 51*a*, 51*b* contribute to a part of the electrolytic liquid such as that from the discharge orifices 40 of the eductors 39 being led according to arrows 55 along the substrates 2, so that in the immediate vicinity of the substrates 2 there is a relatively high volume flow of electrolytic liquid, in a direction opposite to the transport direction 9. Thus, the renewal rate of electrolytic liquid near the substrates 2 is relatively high, so that an increased deposition rate of the respective metal ions from the electrolytic liquid onto the substrates 2 can take place.

At the level of the undersides of the substrates 2, the guide bodies 51*a*, 51*b* are each provided with guide edges 46*a*, 46*b* directed towards each other. Between the guide edges 46*a*, 46*b* there is a gap, the width of which is just sufficient for the substrates 2 to be conveyed through without contact. The guide edges 46*a*. 46*b* thereby contribute to the substrates 2 maintaining a vertical orientation during transport.

When using system 1 (or 1'), the substrates 2 are transported through the electrolytic liquid 4 by conveyor 5 with a transport speed between 5 metres per minute and 10 metres per minute. The speed difference between the substrates 2 on the one hand and the electrolytic liquid, in so far as in the direct vicinity of the substrates 2, may however be significantly greater, for example between 10 metres per minute and 40 metres per minute, owing to the stream of electrolytic liquid 3 that is generated by eductors 39. In this way, relatively high deposition rates can be reached, such as at least 10 micrometres per minute in electrodeposition of copper and at least 20 micrometres per minute in electrodeposition of tin. The total length of the bath 3 is typically between approx. 7.2 metres and 16.8 metres, wherein the bath may be made up from a number of interconnecting bath segments each with a length of for example 2.4 metres. It can easily be calculated from the above data that the total residence time of the substrates 2 in the bath 3 is typically between approx. 0.72 minutes and 3.36 minutes. The counterflow as created by the flow devices 38*a*, 38*b* is such that the distance over which the counterflow extends within bath 3 is almost equal to, so at least 90% of, the length of the bath 3 and in any case longer the dimension of each of the pate-shaped substrates 2 seen in the transport direction 9.

Although the invention has been described above referring to an embodiment of a system having a single bath 3, in other embodiments a system may have more than one, for instance four, baths such as bath 3, which baths are aligned with each other. In such a system the conveyor conveys the substrates successively according to a straight transport path through each of those baths, the electrolytic fluids in each of those baths being in counterflow with respect to the transport direction. The system would have a single overflow space from which each bath is fed with electrolytic fluid and to which electrolytic fluid flowing over the respective overflow edges of each bath would flow.

In order to show that the process according to the invention achieves one or more of the aforementioned aims, experiments have been carried out. Examples 1a and 1b were carried out according to the prior art with continuous electrolytic deposition on substrates from an electrolytic bath with supply of electrolytic liquid by means of a supply pipe that discharges into the bath under the substrates, wherein there is no question of counterflow. Examples 2a and 2b were carried out according to the present invention with continuous electrolytic deposition on substrates from an electrolytic bath with supply of electrolytic liquid by means of counterflow. As will be seen from the following examples, one or more of the aims of the invention are obtained with the present process.

EXAMPLES

Comparative Example 1

A continuous electrolytic deposition line for solar cells, as described in WO 2009/126021 A2, is used, comprising elongated baths for electrolytic processes, wherein first copper was deposited by vacuum deposition to a thickness of 150 nanometres on the surface of a silicon-based substrate (i.e. M6 format (166×166 mm) silicon solar cells), after which an insulating mask was applied by printing to obtain copper tracks.

A number of substrates provided with tracks were suspended in an electrolytic liquid. This electrolytic liquid was prepared from copper sulphate (220 g/l $CuSO_4$ $5H_2O$), sulphuric acid (100 g/l $H_2SO_4$ (96%)), hydrochloric acid (70 mg/l HCl (36%)) and an additive that is known in the art and that is used to ensure good growth of the copper layer (60 m/l S-691 high speed copper additive (Sytron Pte Ltd)). The electrolytic liquid was brought to a temperature between 35 and 40° C. and the substrates were moved at a speed of 5 m/min through the electrolytic liquid.

A current density of 14 A/dm$^2$ (deposition rate of 3.1 micrometres per minute) was used in Example 1a, and a current density of 18 A/dm$^2$ (deposition rate of 4 micrometres per minute) in Example 1b, to obtain a substrate provided with a copper layer on the tracks with a total copper layer thickness of about 26 micrometres, to which the deposition time is adjusted. A higher current density gives a shorter deposition time to obtain the same layer thickness. The thickness, shape and roughness of the tracks provided with copper were determined visually using a 3D laser microscope, evaluating whether the tracks obtained are flat and smooth.

As can be seen in Table 1, a current density of 14 A/dm$^2$ (example 1a) gives the desired flat, smooth contact fingers, whereas increasing the current density to 18 A/dm$^2$ (example 1b) gives tracks wherein the edges are 25-30% thicker than in the middle because nodules have formed on the edges. It can be seen from this example that a speed difference of about 5 m/min between the substrates and the electrolytic liquid is insufficient to deposit electrolytic copper at a speed of 4 micrometres per minute or higher.

Example 2 According to the Invention

Figure 2:
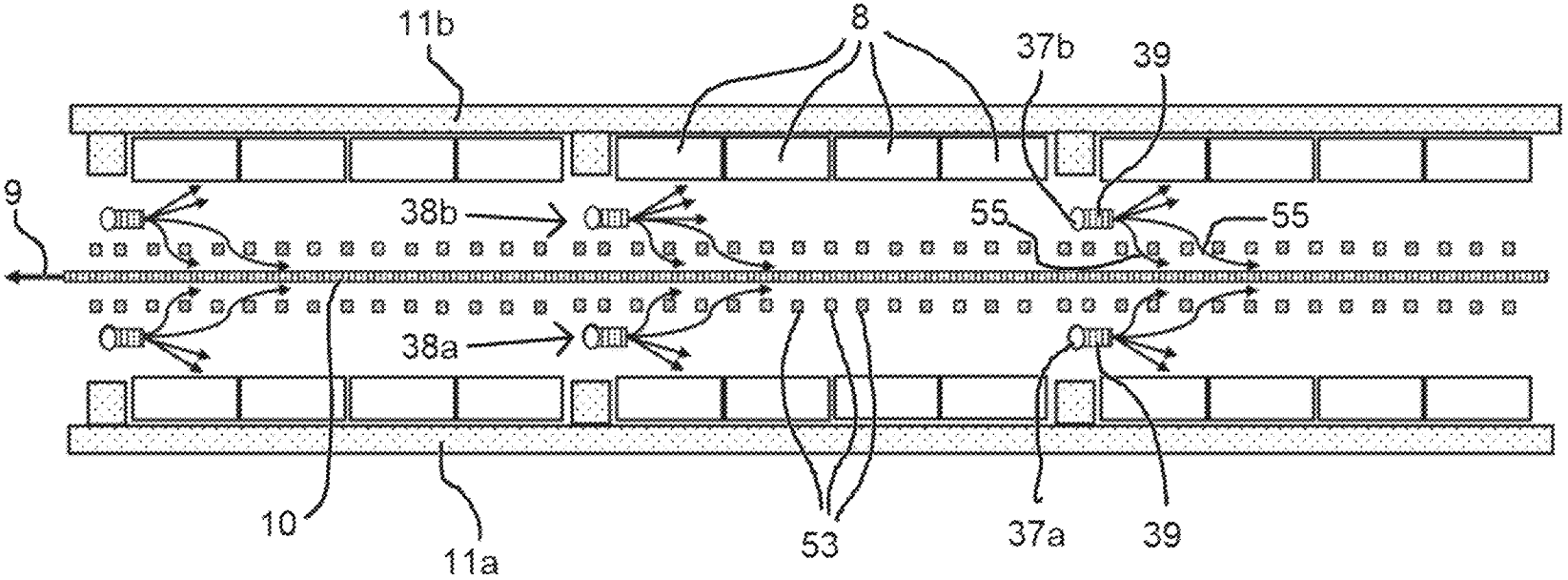
FIG. 2 shows the system according to FIG. 1 in top view.

This example was carried out in the same way as in example 1, with the following adjustments. The tests were carried out in a continuous electrolytic deposition line for solar cells, as in example 1, wherein in these baths the electrolytic liquid is supplied by means of a row of three eductors placed vertically above one another on either side of the solar cell, as shown in FIGS. 1 to 3.

The substrates, solar cells of M2 format (156.75×156.75 mm), were moved at a speed of 1.5 m/min through the electrolytic liquid.

A current density of 50 A/dm$^2$ (deposition rate of 11.1 micrometres per minute) was used in Example 2a and a current density of 60 A/dm$^2$ (deposition rate of 13.3 micrometres per minute) in Example 2b, to obtain a substrate provided with a copper layer on the tracks with a total copper layer thickness of about 20 micrometres, to which the deposition time is adjusted. The thickness, shape and roughness of the tracks provided with copper were determined visually using a 3D laser microscope, evaluating whether the tracks obtained are flat and smooth.

As can be seen in Table 1, smooth, flat substrates are obtained for current densities that are much greater than in Example 1. It can be seen from this example that a speed difference of about 20 m/min between the substrates and the electrolytic liquid (calculated speed difference based on flow rate of liquid and throughput speed of substrates) is sufficient to deposit electrolytic copper at a speed of up to 13 micrometres per minute. It can be seen from this that for Example 1 at higher current density, the surface is unevenly nodular with an excessive percentage deviation (<−20%).

TABLE 1

| Test overview | | | | | |
|---|---|---|---|---|---|
| Ex. No. | Current density ($A/dm^2$) | Deposition rate (μm/min) | Visual assessment | Deviation (%) | Ra (μm) |
| 1a | 14 | 3.1 | Flat/smooth | −17 | 1.1 |
| 1b | 18 | 4 | Uneven/nodular | −21 | 1.9 |
| 2a | 50 | 11.1 | Flat/smooth | −11 | 0.8 |
| 2b | 60 | 13.3 | Flat/smooth | −5 | 0.5 |

Although the invention is explained above on the basis of an embodiment example wherein it is a question of electrodeposition, the invention may also be applied suitably with other types of electrolytic treatments of substrates, such as etching, cleaning and polishing of substrates.

The invention claimed is:

1. A system for electrolytic treatment of vertically oriented substrates, comprising:

an elongated bath for electrolytic liquid, a conveyor for conveying substrates to be treated electrolytically, vertically oriented and suspended from the conveyor, in a transport direction according to a horizontal transport path through an electrolytic liquid in the bath, the conveyor being arranged for clamping the substrates near a top thereof during conveyance of the substrates through the electrolytic liquid in the bath, and a number of eductor flow devices each with at least one constricted intake and at least one discharge orifice in the bath, said discharge orifices being directed in a discharge direction that extends opposite to the transport direction to create a flow of electrolytic liquid with a flow direction that is opposite to the transport direction in the electrolytic liquid along at least one longitudinal side of substrates suspended from the conveyor, said at least one constricted intake increases a speed of the flow of electrolytic liquid from the at least one constricted intake to the at least one discharge orifice.

2. The system according to claim 1, further comprising at least one substrate suspended from the conveyor, wherein the flow devices are arranged for creating a flow of electrolytic liquid with a flow direction that is opposite to the transport direction in the electrolytic liquid along the full dimension of the at least one substrate seen in the transport direction.

3. The system according to claim 1, wherein the flow devices are arranged for creating flow of electrolytic liquid with a flow direction that is opposite to the transport direction in the electrolytic liquid over a distance which is at least equal to 90% of the length of the bath.

4. The system according to claim 1, wherein the conveyor is arranged for conveying substrates over the full length of the bath from an end of the bath to an opposite end of the bath.

5. The system according to claim 1, wherein the discharge orifices are provided seen in top view on two opposite sides of the transport path for creating the flow of electrolytic liquid along two opposite sides.

6. The system according to claim 1, wherein at least two discharge orifices are aligned to form at least one row.

7. The system according to claim 1, wherein the system comprises at least one tank for electrolytic liquid, said at least one tank being installed outside the bath and each eductor flow device of the number of eductor flow devices being connected to one tank of the at least one tank via supply lines that extend via a passage in a wall or the bottom of the bath.

8. The system according to claim 1, wherein each eductor flow device is provided with not more than one discharge orifice.

9. The system according to claim 1, wherein the system comprises at least one guide body for guiding, in the direction of the substrates, electrolytic liquid that flows in respective flow directions from discharge orifices.

10. The system according to claim 1, wherein the bath is provided with a receiving space that is positioned directly under the transport path for receiving substrates or parts thereof that come loose from the conveyor during transport of the substrates.

11. The system according to claim 1, wherein the system comprises two or more baths which are aligned with each other, the conveyor being arranged for conveying the substrates successively through electrolytic fluid in each of the baths according to a straight transport path.

12. A method for electrolytic treatment of vertically oriented substrates when using a system according to one of the preceding claims, comprising the steps of:

conveying in a horizontal transport direction, by means of a conveyor, vertically oriented substrates suspended from the conveyor through an electrolytic liquid in an elongated bath for electrolytic liquid while the substrates are clamped near a top thereof by the conveyor during said conveyance; and creating in the elongated bath, from a number of eductor flow devices with each eductor flow device having at least one constricted intake and at least one discharge orifice, a flow of electrolytic liquid along at least one longitudinal side of the substrates suspended from the conveyor, said discharge orifices being directed in a discharge direction that extends opposite to the transport direction to create a flow of electrolytic liquid with a flow direction that is opposite to the transport direction in the electrolytic liquid along at least one longitudinal side of substrates suspended from the conveyer, said at least one constricted intake increases a speed of the flow of electrolytic liquid from the at least one constricted intake to the at least one discharge orifice, performing electrolytic treatment of the substrates in the electrolytic liquid during transport of the substrates.

13. The method according to claim 12, wherein the created flow has a flow direction that is opposite to the transport direction over a distance which is at least equal to the full dimension of a substrate seen in the transport direction.

14. The method according to claim 12, wherein the substrates are conveyed over the full length of the elongated bath from an end of the elongated bath to an opposite end of the bath.

15. The method according to claim 12, wherein the magnitude of the speed difference between the substrates and the flow is between 10 metres per minute (m/min) and 40 metres per minute (m/min).

16. The method according to claim 12, wherein the speed of the substrates is between 5 metres per minute (m/min) and 10 metres per minute (m/min).

17. The method according to claim 12, wherein during the electrolytic treatment there is an average current density on the substrate of at least 30 amperes per square decimetre ($A/dm^2$).

18. The method according to claim 12, wherein a bottom of a receiving space of the elongated bath is located at a distance below undersides of substrates suspended from the conveyor, said distance being greater than the vertical dimension of the substrates suspended from the conveyor.

19. A system for electrolytic treatment of vertically oriented substrates, comprising:

an elongated bath for electrolytic liquid, a conveyor for conveying substrates to be treated electrolytically, vertically oriented and suspended from the conveyor, in a transport direction according to a horizontal transport path through an electrolytic liquid in the bath, the conveyor being arranged for clamping the substrates near a top thereof during conveyance of the substrates through the electrolytic liquid in the bath, a number of eductor flow devices each with at least one constricted intake and at least one discharge orifice in the bath, said discharge orifices being directed in a discharge direction that extends opposite to the transport direction to create a flow of electrolytic liquid with a flow direction that is opposite to the transport direction in the electrolytic liquid along at least one longitudinal side of substrates suspended from the conveyor, said at least one constricted intake increases a speed of the flow of electrolytic liquid form the at least one constricted intake to the at least one discharge orifice, and at least one guide body for guiding, in the direction of the substrates, electrolytic liquid that flows in respective flow directions from discharge orifices, wherein the at least one guide body is plate-shaped and has one or more guide passages, wherein the at least one guide body extends vertically and parallel to the transport path, wherein the at least one guide body is provided between the transport path and at least one discharge orifice.

20. A system for electrolytic treatment of vertically oriented substrates, comprising:

an elongated bath for electrolytic liquid, a conveyor for conveying substrates to be treated electrolytically, vertically oriented and suspended from the conveyor, in a transport direction according to a horizontal transport path through an electrolytic liquid in the bath, the conveyor being arranged for clamping the substrates near a top thereof during conveyance of the substrates through the electrolytic liquid in the bath, and a number of eductor flow devices each with at least one constricted intake and at least one discharge orifice in the bath, said discharge orifices being directed in a discharge direction that extends opposite to the transport direction to create a flow of electrolytic liquid with a flow direction that is opposite to the transport direction in the electrolytic liquid along at least one longitudinal side of substrates suspended from the conveyor, said at least one constricted intake increases a speed of the flow of electrolytic liquid from the at least one constricted intake to the at least one discharge orifice, wherein at least two discharge orifices are aligned to form at least one row, wherein at least one row of the at least one row extends in the horizontal direction, wherein at least one row of the at least one row extends in the vertical direction, wherein the discharge orifices belonging to a vertical row are connected to a common supply line for electrolytic liquid.

* * * * *